US010914532B2

(12) United States Patent
Kim

(10) Patent No.: US 10,914,532 B2
(45) Date of Patent: Feb. 9, 2021

(54) CURVED PLATE HEAT EXCHANGER

(71) Applicant: KYUNGDONG NAVIEN CO., LTD., Pyeongtaek-si (KR)

(72) Inventor: Young Mo Kim, Seoul (KR)

(73) Assignee: KYUNGDONG NAVIEN CO., LTD., Pyeongtaek-si (KR)

( * ) Notice: Subject to any disclaimer, the term of this patent is extended or adjusted under 35 U.S.C. 154(b) by 257 days.

(21) Appl. No.: 15/755,367

(22) PCT Filed: Sep. 1, 2016

(86) PCT No.: PCT/KR2016/009777
§ 371 (c)(1),
(2) Date: Feb. 26, 2018

(87) PCT Pub. No.: WO2017/039346
PCT Pub. Date: Mar. 9, 2017

(65) Prior Publication Data

US 2018/0252478 A1 Sep. 6, 2018

(30) Foreign Application Priority Data

Sep. 4, 2015 (KR) ..... 10-2015-0125315

(51) Int. Cl.
*F28F 3/04* (2006.01)
*F24H 1/12* (2006.01)
(Continued)

(52) U.S. Cl.
CPC ..... *F28F 3/04* (2013.01); *F24H 1/12* (2013.01); *F24H 9/18* (2013.01); *F28D 9/0043* (2013.01);
(Continued)

(58) Field of Classification Search
CPC . F28F 3/04; F28F 3/08; F28F 2265/10; F28D 21/0007; F28D 9/0043; F28D 2021/0024; F24H 9/18; F24H 1/12
See application file for complete search history.

(56) References Cited

U.S. PATENT DOCUMENTS 3,228,464 A * 1/1966 Stein ..... F28D 9/0012 165/166
3,255,818 A * 6/1966 Beam, Jr. ..... F02G 5/02 165/166
(Continued)

FOREIGN PATENT DOCUMENTS

CN 103791758 A 5/2014
EP 2420791 A2 2/2012
(Continued)

OTHER PUBLICATIONS

International Search Report of PCT/KR2016/009777, dated Dec. 8, 2016, English translation.

*Primary Examiner* — Ljiljana V. Ciric
(74) *Attorney, Agent, or Firm* — STIP Law Group, LLC

(57) ABSTRACT

A curved plate heat exchanger includes a heat exchange unit in which heat medium flow paths and combustion gas flow paths are alternately formed to be adjacent to each other in spaces between a plurality of plates, wherein the plurality of plates are configured in such a manner whereby a plurality of unit plates, in which first and second plates are stacked, are formed; wherein the heat medium flow paths are formed between the first plate and the second plate of the unit plate; and wherein the combustion gas flow paths are formed at constant interval between the second plate of the unit plate located on one side of the adjacent unit plates and the first plate of the unit plate located on the other side.

17 Claims, 14 Drawing Sheets

(51) Int. Cl.

| | |
|---|---|
| ***F24H 9/18*** | (2006.01) |
| ***F28D 9/00*** | (2006.01) |
| ***F28D 21/00*** | (2006.01) |
| ***F28F 3/08*** | (2006.01) |

(52) U.S. Cl.
CPC ..... *F28D 21/0007* (2013.01); *F28F 3/08* (2013.01); *F28D 2021/0024* (2013.01); *F28F 2265/10* (2013.01)

(56) References Cited

U.S. PATENT DOCUMENTS 3,613,782 A * 10/1971 Mason ..... F28D 9/0068 165/166
3,924,441 A * 12/1975 Kun ..... B21D 22/04 72/475
4,119,144 A * 10/1978 Kun ..... B21D 22/04 165/175
4,291,752 A * 9/1981 Bridgnell ..... F28F 9/005 165/81
4,503,908 A * 3/1985 Rosman ..... F28D 9/0018 165/167
4,523,638 A * 6/1985 Rosman ..... F28D 9/0018 165/167
4,913,776 A * 4/1990 Finnemore ..... F28D 9/0025 165/166
5,025,856 A * 6/1991 Vandyke ..... F28F 3/086 165/166
5,301,747 A * 4/1994 Daschmann ..... F28D 9/0037 165/166
5,613,553 A * 3/1997 Hong ..... F24H 1/30 165/140
6,180,846 B1 * 1/2001 Dandekar ..... F28D 9/0037 585/443
6,250,380 B1 * 6/2001 Strahle ..... F28D 9/0043 165/167
6,357,396 B1 * 3/2002 Stansfield ..... F28D 21/0008 122/7 R
6,648,067 B1 * 11/2003 Maute ..... D06F 58/24 165/166
6,684,943 B2 * 2/2004 Dobbs ..... F24F 3/147 165/166
6,935,416 B1 * 8/2005 Tsunoda ..... F28D 9/0018 165/166
7,069,981 B2 * 7/2006 Valensa ..... F28F 9/22 165/164
7,870,671 B2 * 1/2011 Rissler ..... F28D 9/005 29/890.043
8,235,093 B2 * 8/2012 Grinbergs ..... H01M 8/04007 165/8
9,127,895 B2 * 9/2015 Neher ..... F28D 7/1684
9,163,882 B2 * 10/2015 Crawford ..... F28D 9/005
2002/0174978 A1 * 11/2002 Beddome ..... F28D 9/0043 165/174
2003/0116305 A1 * 6/2003 Beddome ..... F28F 9/0131 165/81
2003/0145979 A1 * 8/2003 Beddome ..... F28F 9/013 165/81
2003/0159807 A1 * 8/2003 Ayres ..... F28F 9/0075 165/81
2004/0013585 A1 * 1/2004 Whyatt ..... F28D 9/0093 422/177
2004/0069475 A1 * 4/2004 Brost ..... F02M 26/32 165/173
2004/0258587 A1 * 12/2004 Bowe ..... B01J 23/40 422/222
2005/0056411 A1 * 3/2005 Dilley ..... F28D 9/0018 165/167
2006/0105213 A1 * 5/2006 Otsuka ..... H01M 8/0228 429/435
2007/0000652 A1 * 1/2007 Ayres ..... F28F 3/04 165/158
2007/0266702 A1 * 11/2007 Cotton ..... F28D 9/0043 60/298
2008/0202735 A1 * 8/2008 Geskes ..... F28D 9/0043 165/166
2009/0211740 A1 * 8/2009 Kesseli ..... F28D 9/0043 165/166
2010/0139900 A1 * 6/2010 Thompson ..... F28F 3/025 165/166
2010/0282452 A1 * 11/2010 Diem ..... F01K 25/10 165/167
2011/0180234 A1 * 7/2011 Wickham ..... F28D 7/106 165/100
2013/0105128 A1 * 5/2013 Vanderwees ..... F28D 9/0068 165/165
2014/0216700 A1 * 8/2014 Odillard ..... F28D 9/00 165/166
2014/0238641 A1 * 8/2014 Gerges ..... F28D 9/0056 165/76
2014/0246185 A1 * 9/2014 Onetti ..... F28F 3/08 165/166
2014/0251579 A1 * 9/2014 Sloss ..... F28D 21/0003 165/96
2015/0308756 A1 * 10/2015 Lee ..... F28F 1/40 165/109.1
2016/0084584 A1 * 3/2016 Stapp ..... F02C 1/04 165/81
2016/0195337 A1 * 7/2016 Holiday ..... F24H 9/0005 165/104.19
2017/0115026 A1 * 4/2017 Veltkamp ..... F28F 21/065
2017/0343292 A1 * 11/2017 Raunio ..... F28F 9/005
2018/0017024 A1 * 1/2018 Hermida Dominguez ..... F28F 3/046
2018/0245857 A1 * 8/2018 Kim ..... F24H 1/40
2018/0372425 A1 * 12/2018 Yanagimoto ..... F28F 1/06

FOREIGN PATENT DOCUMENTS

| | | | |
|---|---|---|---|
| JP | H09196591 | A | 7/1997 |
| JP | 2001041678 | A | 2/2001 |
| JP | 2002048491 | A | 2/2002 |
| JP | 2006342997 | A | 12/2006 |
| JP | 2008267673 | A | 11/2008 |
| KR | 100645734 | B1 | 11/2006 |
| KR | 1020100088598 | A | 8/2010 |
| KR | 101086917 | A | 10/2010 |
| KR | 101400833 | B1 | 5/2014 |
| WO | WO9739301 | A1 | 10/1997 |

* cited by examiner

【FIG. 1】
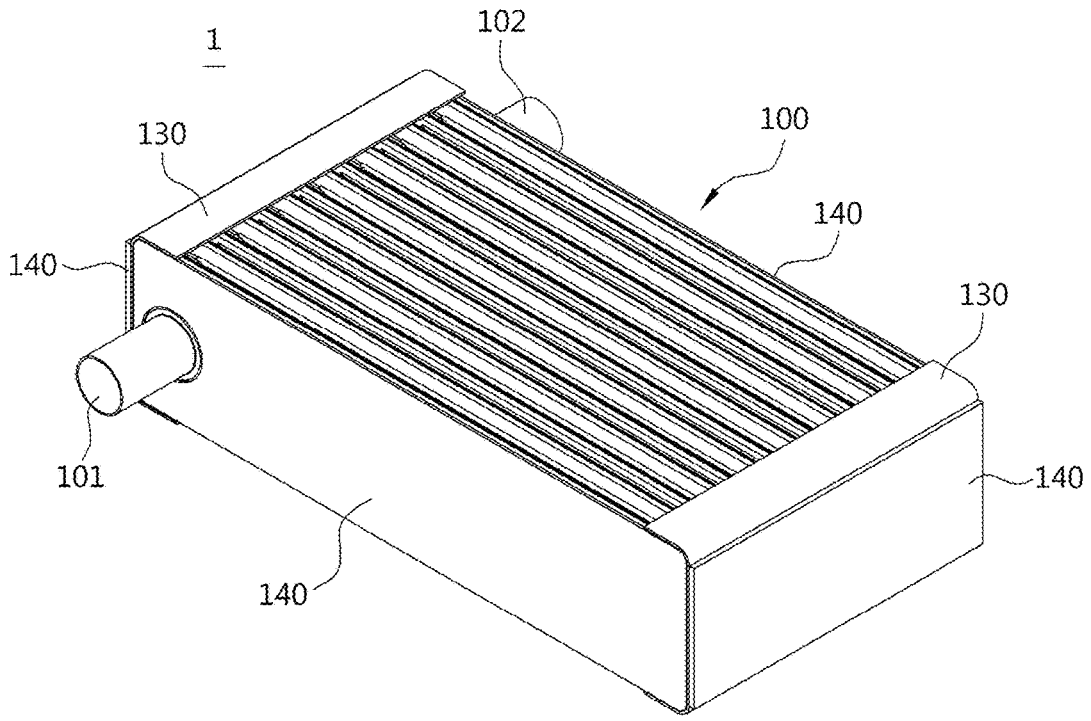

【FIG. 2】
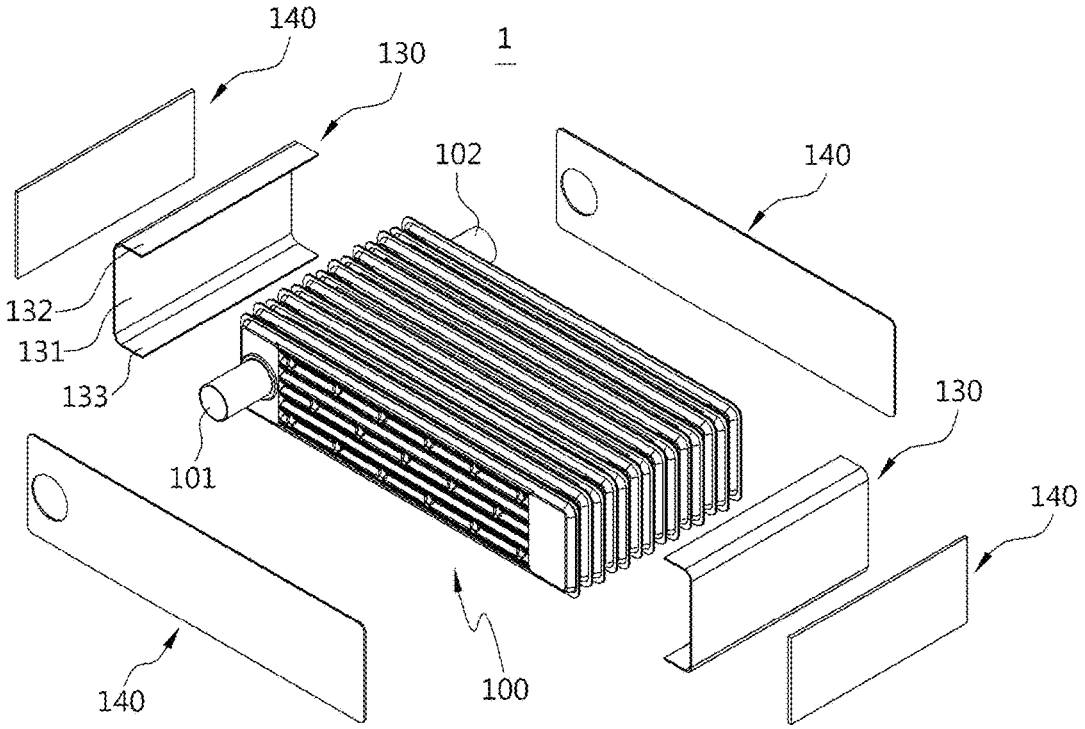

【FIG. 3】
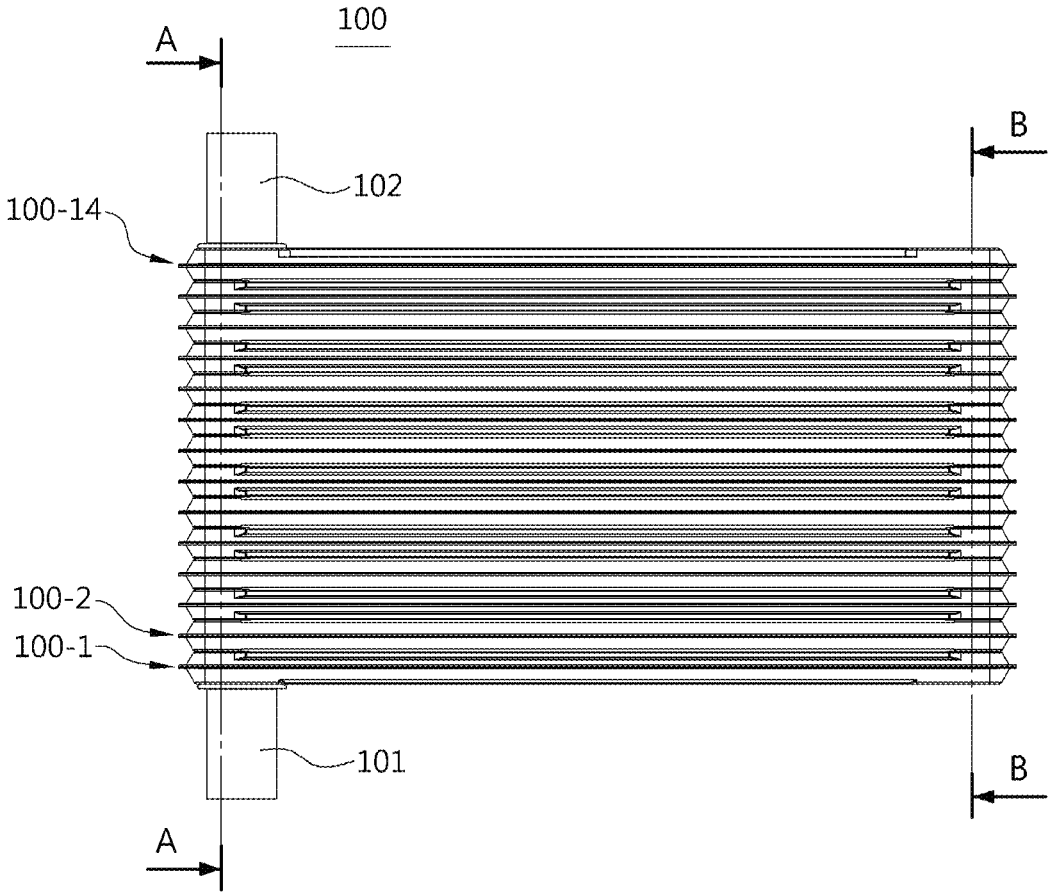

【FIG. 4】
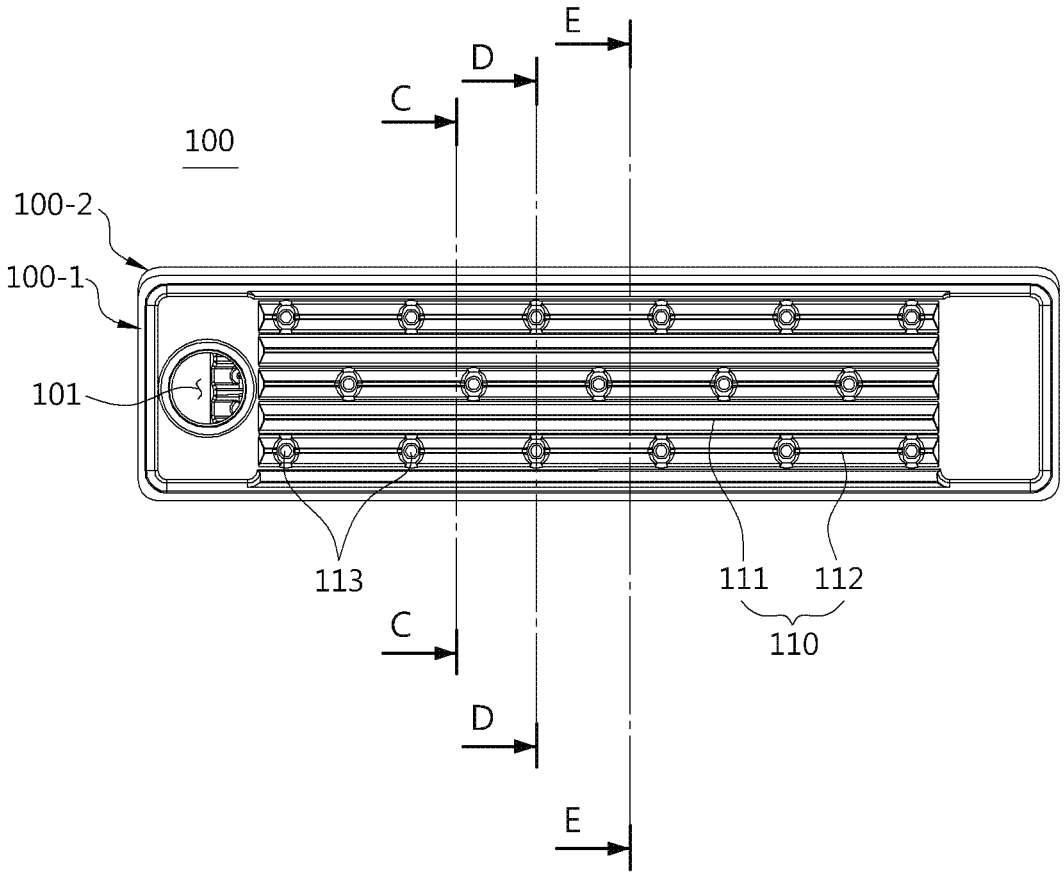

【FIG. 5】
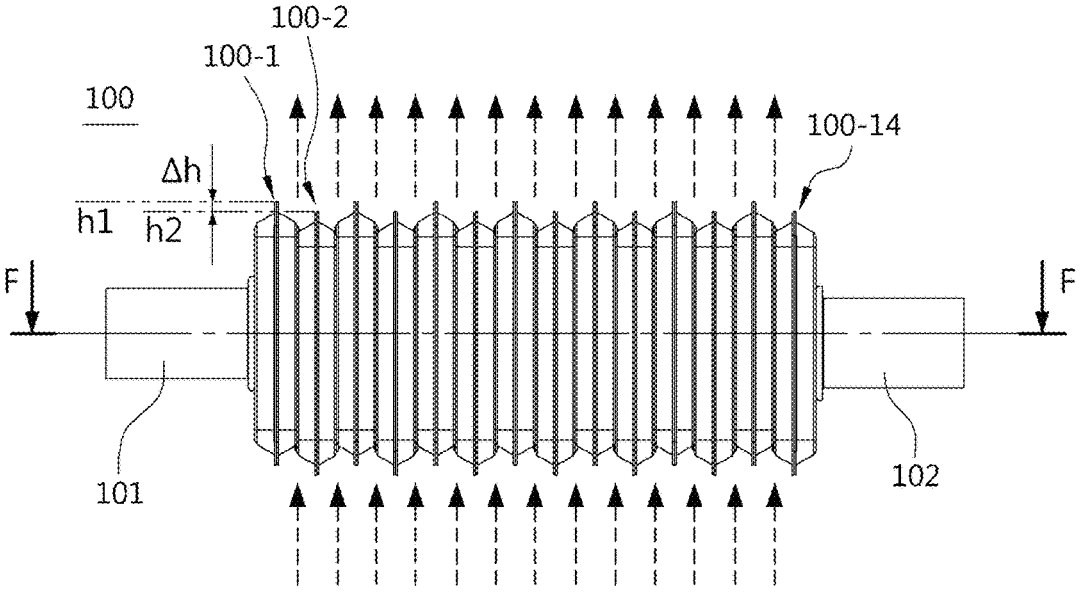

[FIG. 6]
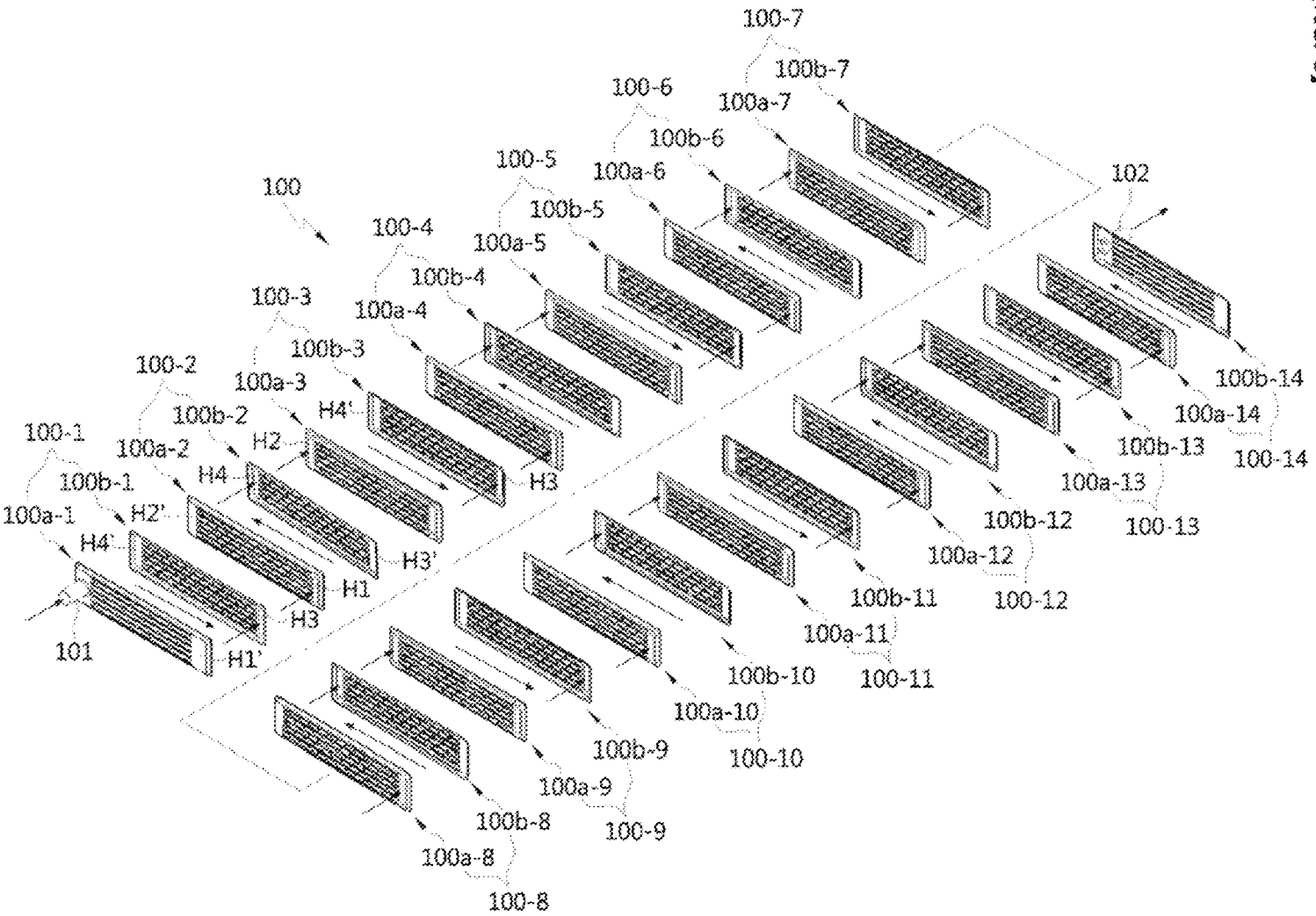

【FIG. 7】
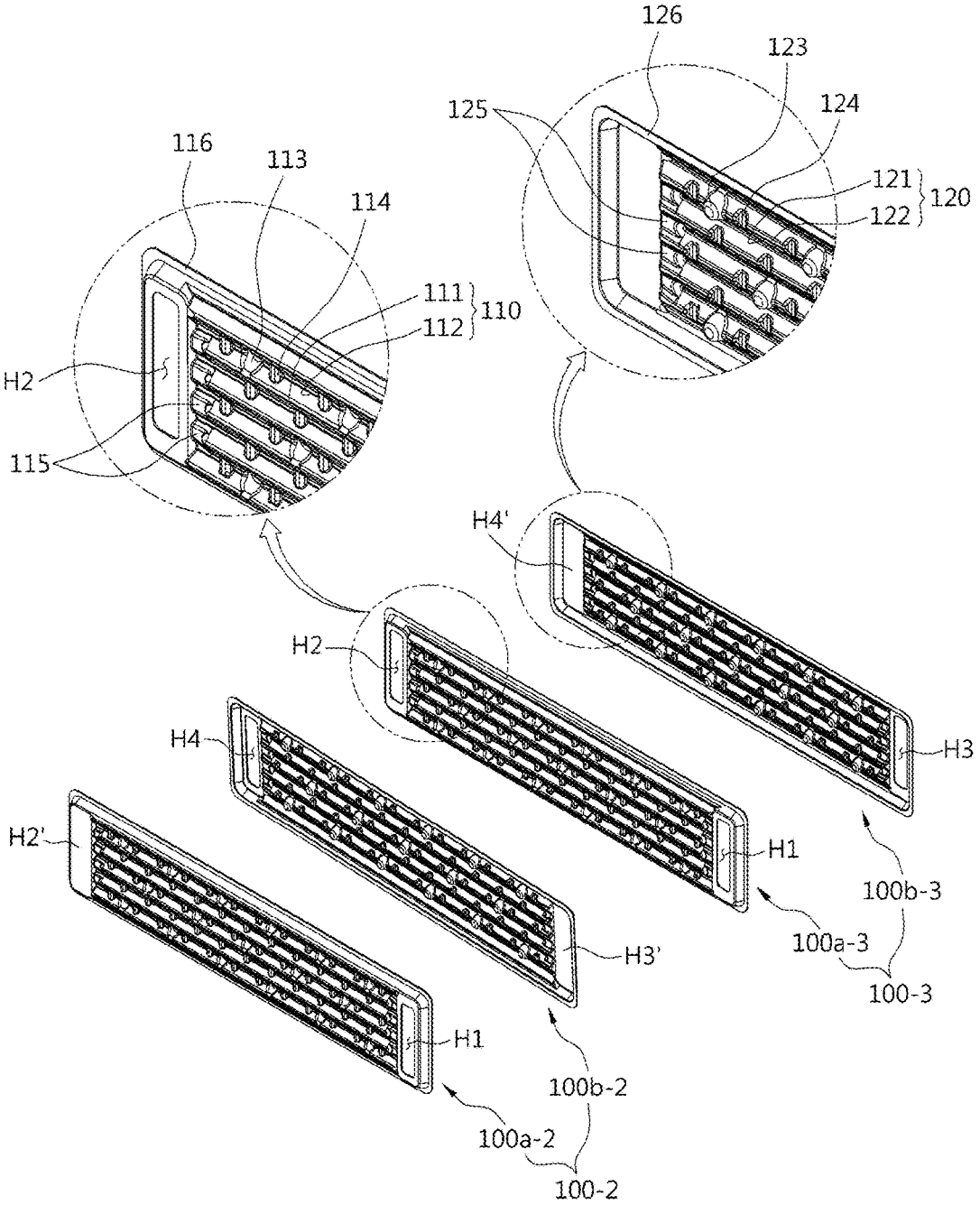

【FIG. 8】
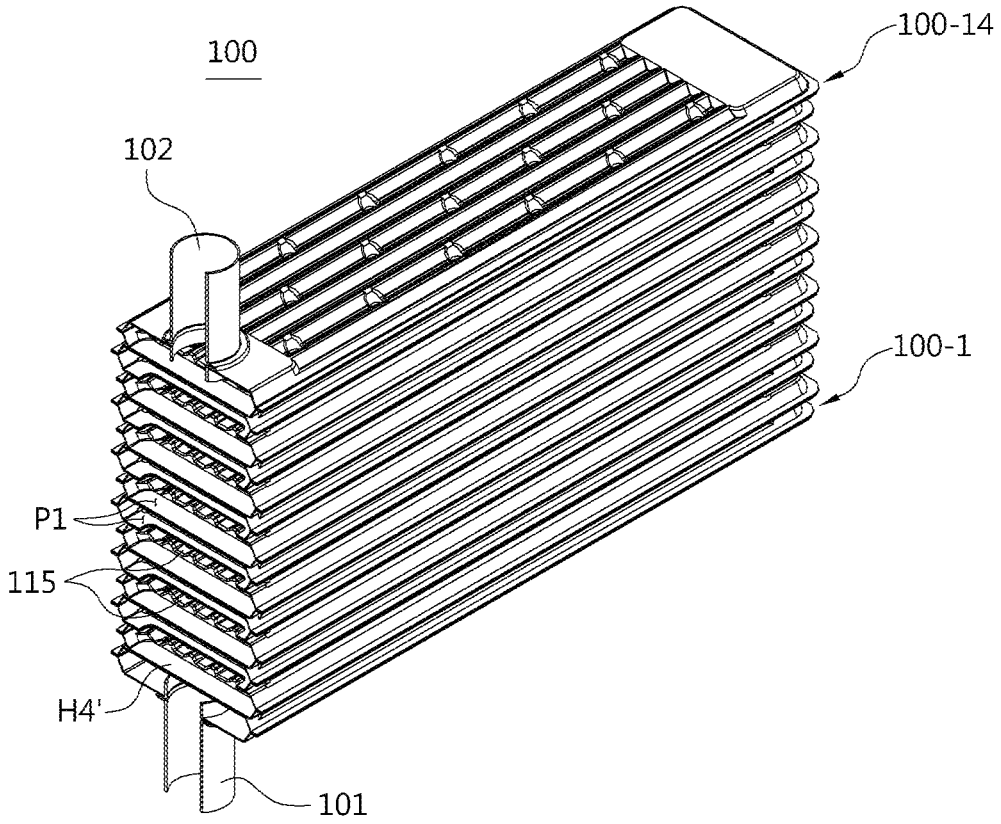

【FIG. 9】
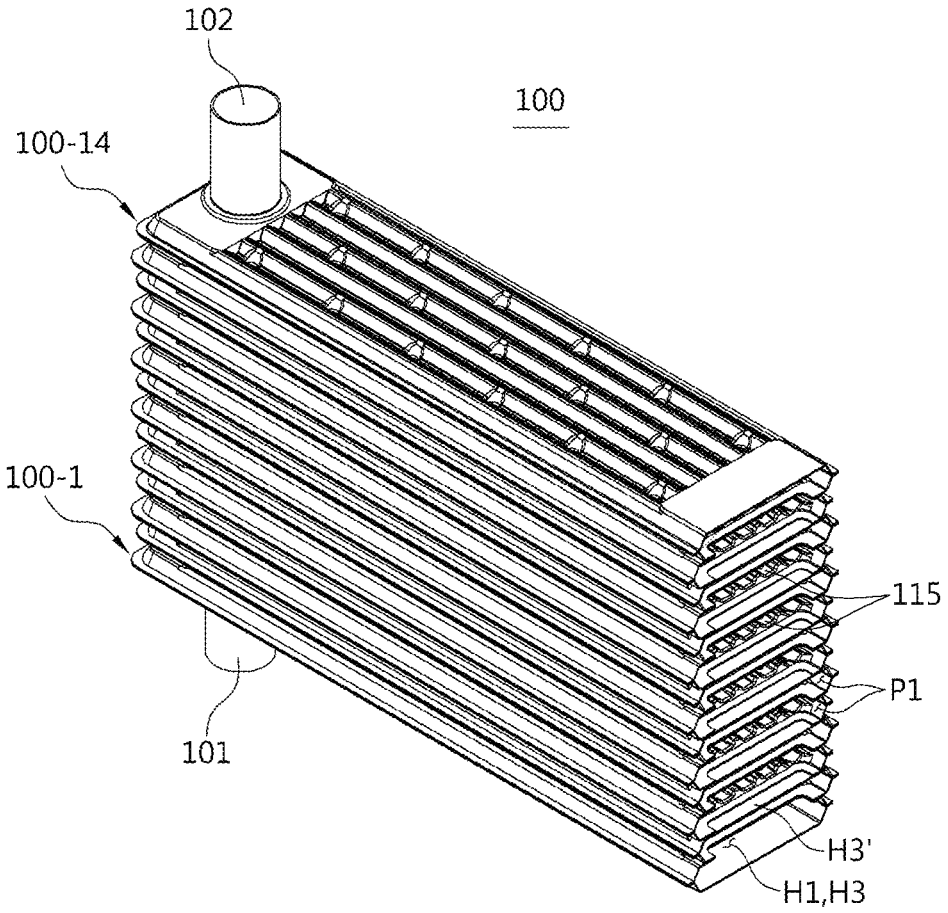

[FIG. 10]
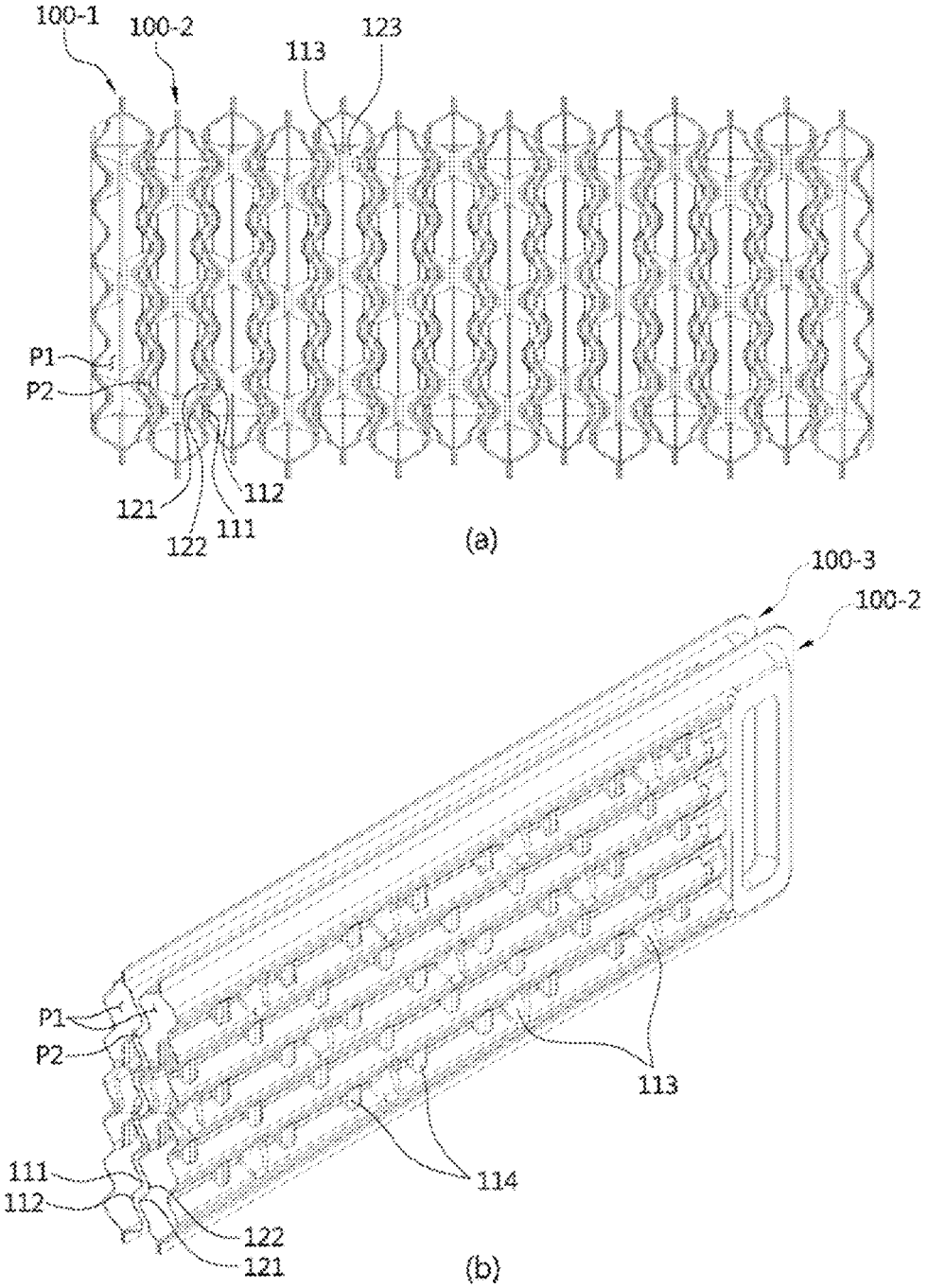

[FIG. 11]
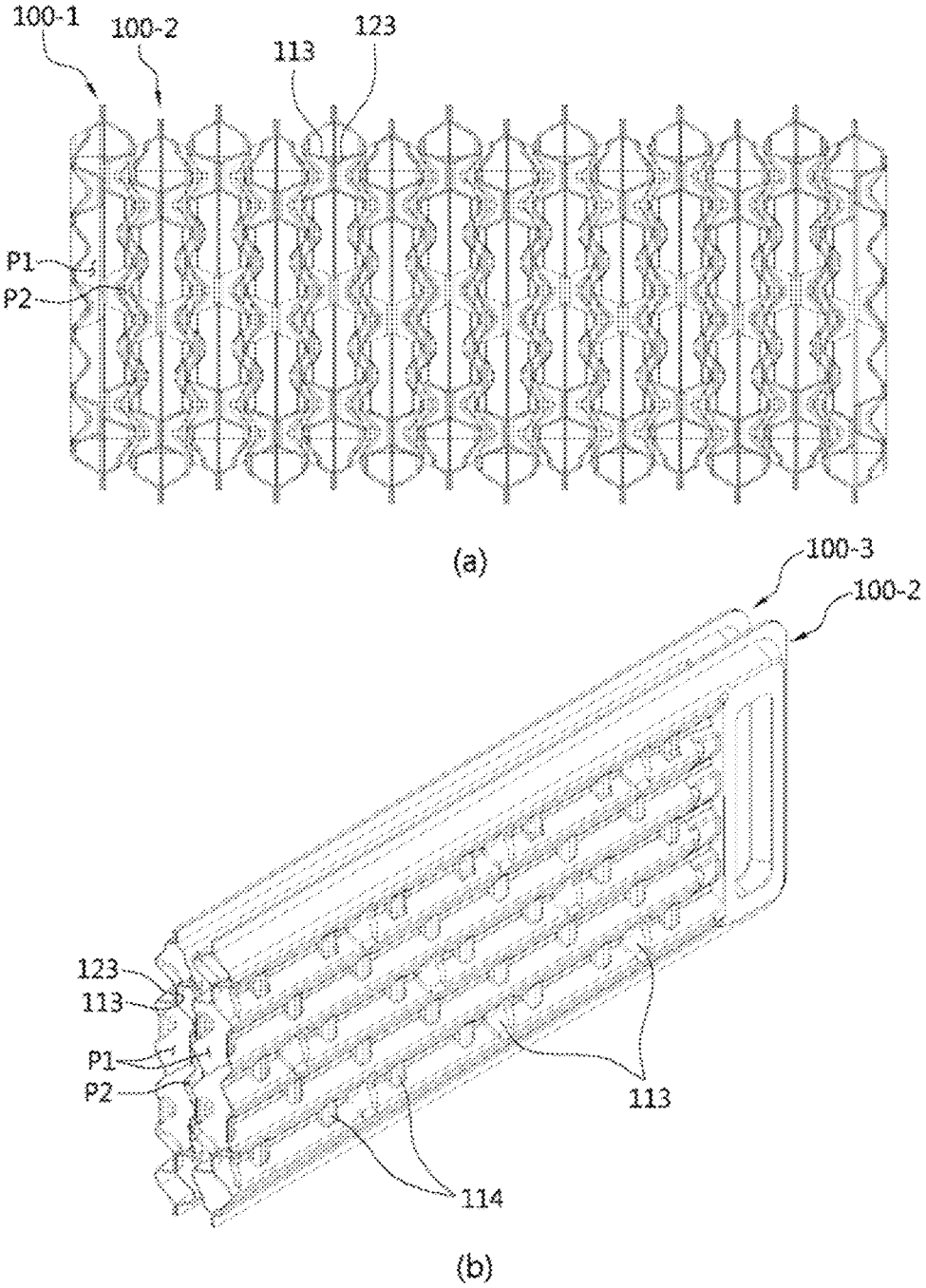

【FIG. 12】
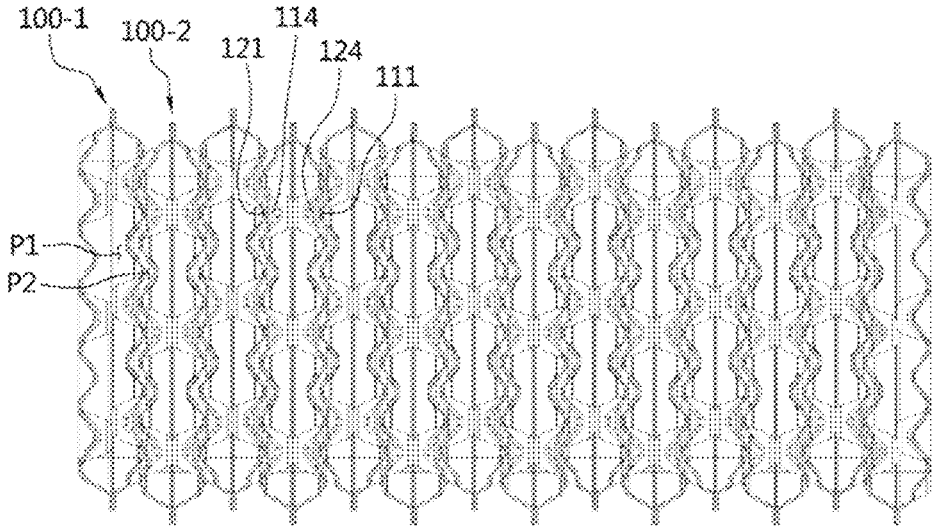
(a)
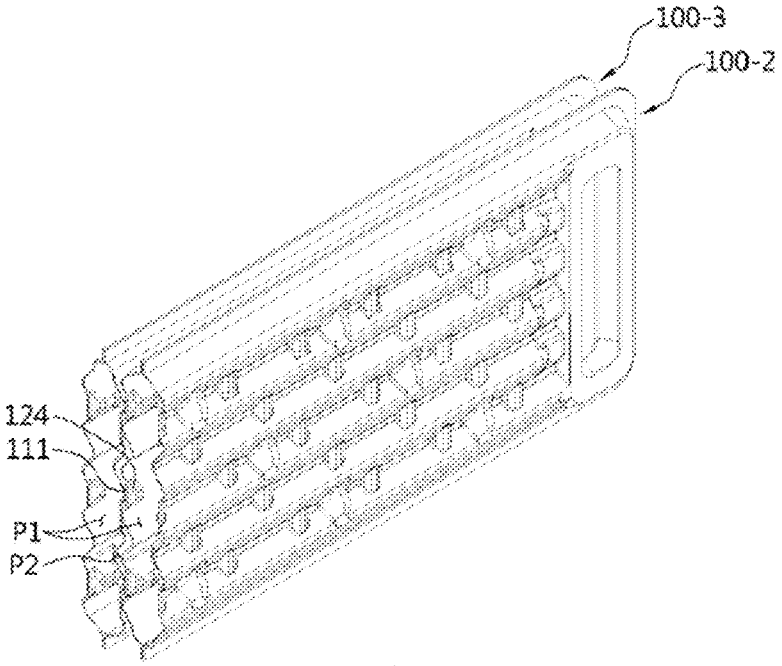
(b)

【FIG. 13】
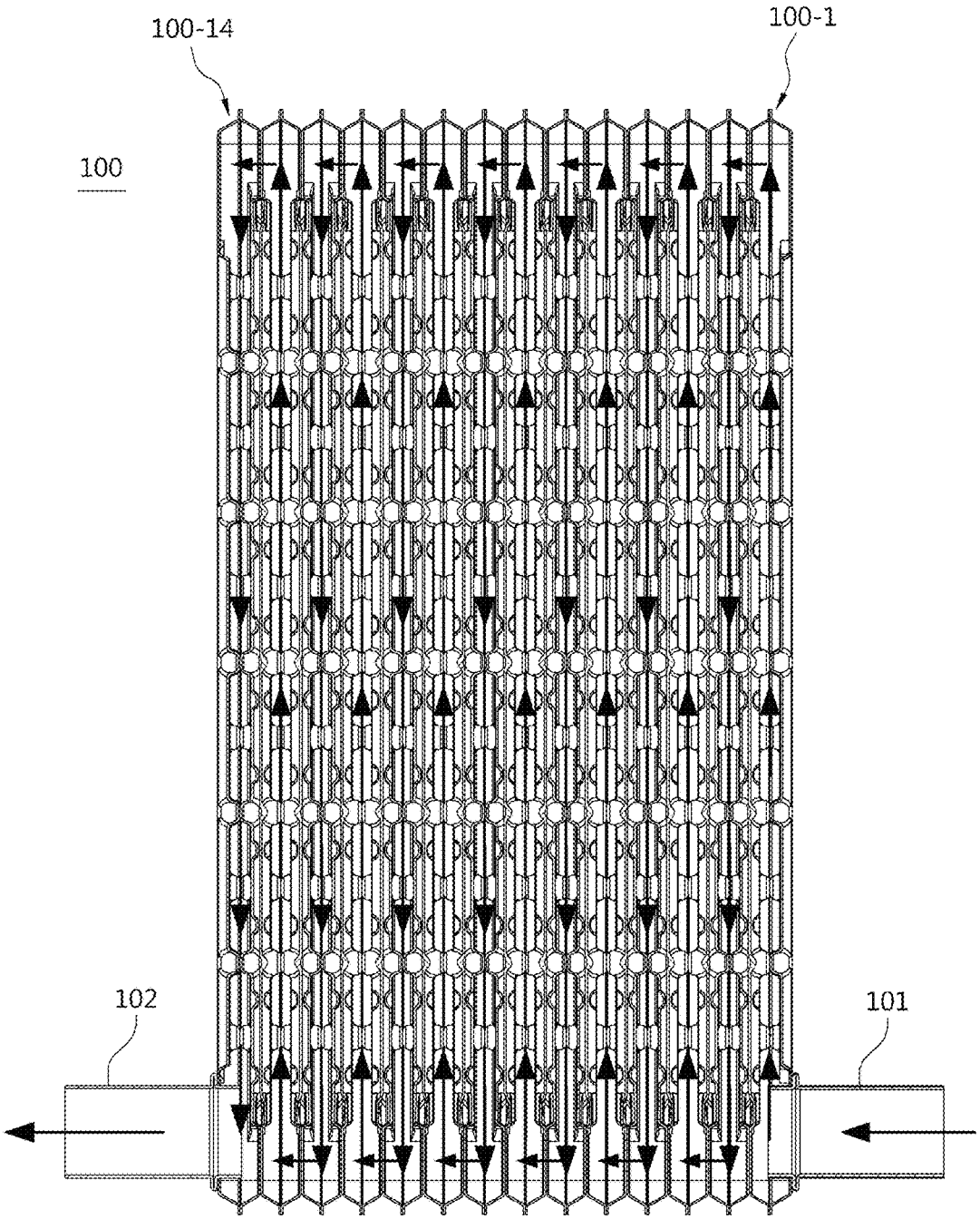

【FIG. 14】
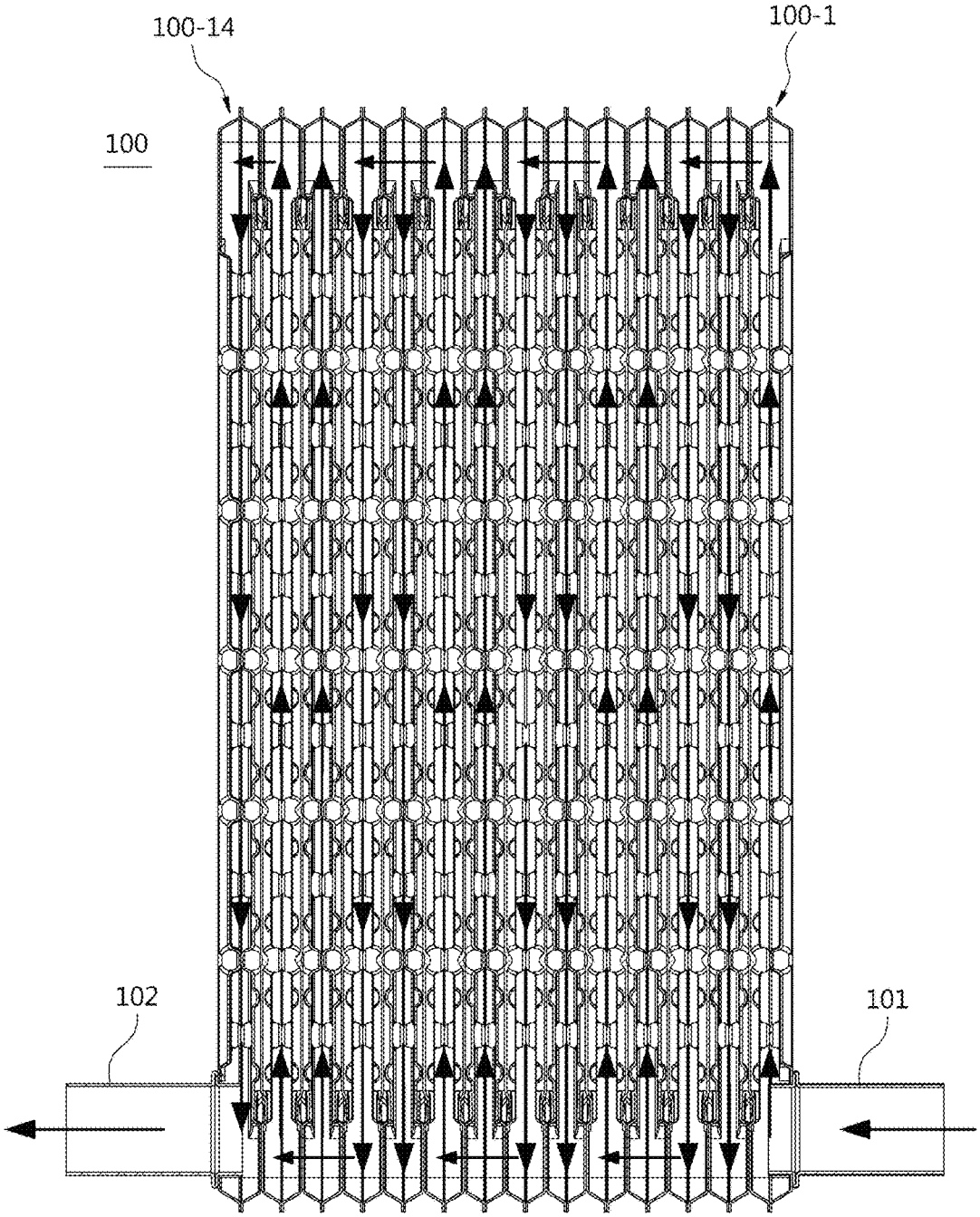

CURVED PLATE HEAT EXCHANGER

CROSS-REFERENCE TO RELATED APPLICATIONS

This application is the U.S. National Phase under 35 U.S.C. § 371 of International Application No. PCT/KR2016/009777 filed on Sep. 1, 2016, which in turn claims the benefit of Korean Application No. 10-2015-0125315, filed on Sep. 4, 2015, the disclosures of which are incorporated by reference into the present application.

TECHNICAL FIELD

The present invention relates to a curved plate heat exchanger, and more particularly, to a curved plate heat exchanger capable of reducing flow resistance of a combustion gas flowing along a combustion gas flow path formed between a plurality of heating medium flow paths and improving heat exchange efficiency between a heating medium and the combustion gas by promoting generation of turbulence.

BACKGROUND ART

Generally, a heating device includes a heat exchanger in which a heat exchange is performed between a heating medium and a combustion gas by combusting fuel, and the heating device performs heating using a heated heating medium or supplies hot water.

A fin-tube type heat exchanger among conventional heat exchangers is configured such that a plurality of heat transfer fins are coupled in parallel to an outer surface of a tube through which a heating medium flows at regular intervals, end plates are coupled to both ends of the tube to which the plurality of heat transfer fins are coupled, and flow path caps are coupled to a front side and a rear side of each of the end plates to change a flow path of the heating medium flowing inside the tube. Such a fin-tube type heat exchanger is disclosed in Korean Registered Patent Nos. 10-1400833 and 10-1086917.

However, the conventional fin-tube type heat exchanger has a problem in that the number of parts is excessive and a connection portion between the parts is coupled by welding, such that a structure of the conventional fin-tube type heat exchanger and a manufacturing process thereof are complicated.

Meanwhile, as another example of the conventional heat exchanger, Korean Registered Patent No. 10-0645734 discloses a structure of a heat exchanger in which a plurality of plates are stacked, and a heating medium flow path and a combustion gas flow path are alternately formed inside the plurality of stacked plates such that a heat exchange is performed between a heating medium and a combustion gas.

However, in the heat exchanger disclosed in the above-described Patent No. 10-0645734, a plate surface is in a comb shape bent to protrude in opposite directions, causing disadvantages of a cross-sectional area of the combustion gas flow path varying according to position such that flow resistance of the combustion gas increases, and a distribution of a temperature transferred from the combustion gas across an entire surface of the plate is not uniform such that an entire flow amount of the heating medium cannot be heated to a uniform temperature.

DISCLOSURE

Technical Problem

The present invention has been made in order to resolve the above-described problems, and it is an objective of the present invention to provide a curved plate heat exchanger capable of reducing flow resistance of a combustion gas flowing along a combustion gas flow path formed between a plurality of heating medium flow paths and improving heat exchange efficiency between a heating medium and the combustion gas by promoting generation of turbulence.

It is another object of the present invention to provide a heat exchanger having a simplified assembly and improved durability by enhancing durability of the heat exchanger.

It is still another object of the present invention to provide a curved plate heat exchanger capable of preventing deterioration of thermal efficiency caused by boiling of a heating medium and preventing corrosion of a metal resulting from a potential difference between different kinds of metals being in contact with each other.

Technical Solution

To achieve the above-described, a curved plate heat exchanger 1 of the present invention includes a heat exchange unit (100) in which a heating medium flow path (P1) and a combustion gas flow path (P2) are alternately formed to be adjacent to each other in a space between a plurality of plates, wherein the plurality of plates constituting the heat exchange unit (100) are configured with a plurality of unit plates in each of which a first plate and a second plate are stacked, the heating medium flow path (P1) is formed between the first plate and the second plate of each of the plurality of unit plates, and the combustion gas flow path (P2) is formed between a second plate disposed at one side of a unit plate among the adjacently stacked unit plates and a first plate disposed at the other side of a unit plate thereamong, and is formed to be kept constant interval along a flow direction of a combustion gas.

The first plate may include a first curved surface (110) having a first ridge portion (111) protruding toward the combustion gas flow path (P2) disposed at the one side and a first valley portion (112) protruding toward the heating medium flow path (P1), wherein the first ridge portion (111) and the first valley portion (112) are alternately formed along the flow direction of the combustion gas and the second plate includes a second curved surface (120) having a second ridge portion (121) protruding toward the combustion gas flow path (P2) disposed at the other side, and a second valley portion (122) protruding toward the heating medium flow path (P1), wherein the second ridge portion (121) and the second valley portion (122) are alternately formed along the flow direction of the combustion gas.

The first ridge portion (111), which is formed at the first plate disposed at the one side of the unit plate among the adjacently stacked unit plates, and the second valley portion (122), which is formed at the second plate disposed at the other side of the unit plate thereamong, may be disposed to face each other and may be spaced apart from each other, and the first valley portion (112) formed at the first plate of the unit plate disposed at the one side and the second ridge portion (121) formed at the second plate of the unit plate disposed at the other side are disposed to face each other and spaced apart from each other.

The adjacently stacked unit plates may be disposed to form a vertical height difference ($\Delta h$) therebetween to allow the first ridge portion (111) of the first plate and the second valley portion (122) of the second plate to be disposed to face each other and allow the first valley portion (112) of the first plate and the second ridge portion (121) of the second plate to be disposed to face each other.

A first turbulence forming protrusion (114) may be formed at the first valley portion (112) of the first plate to be in contact with the second ridge portion (121) formed at the second plate of the adjacently stacked unit plates, and a second turbulence forming protrusion (124) may be formed at the second valley portion (122) of the second plate to be in contact with the first ridge portion (111) formed at the first plate of the adjacently stacked unit plates.

A plurality of first turbulence forming protrusions (114) and second turbulence forming protrusions (124) may be formed and spaced apart from each other along a length direction of the unit plates.

A first reinforcement protrusion (113) may be formed at the first valley portion (112) of the first plate to protrude toward the heating medium flow path (P1), and a second reinforcement protrusion (123) is formed at the second valley portion (122) of the second plate to protrude toward the heating medium flow path (P1) and to be in contact with the first reinforcement protrusion (113).

A plurality of first reinforcement protrusions (113) and second reinforcement protrusions (123) may be formed and spaced apart from each other along the length direction of the unit plates.

A flow path of a heating medium passing through the heating medium flow path (P1) may be formed at the plurality of stacked unit plates in a series structure, and the flow path may be configured such that a flow direction of the heating medium in the unit plate disposed at the one side and a flow direction of the heating medium in the unit plate disposed at the other side may be alternately formed to be opposite to each other.

A flow path of a heating medium passing through the heating medium flow path (P1) may be formed at the plurality of stacked unit plates in a series-parallel mixed structure, and the flow path may be configured such that a flow direction of the heating medium in the plurality of unit plates disposed at the one side and a flow direction of the heating medium in a plurality of unit plates stacked to be adjacent to the plurality of unit plates may be alternately formed to be opposite to each other.

A first flow distributor (115) and a second flow distributor (125) may be formed at both end portions of each of the plurality of unit plates to reduce a cross-sectional area of the heating medium flow path (P1) and a flow velocity of the heating medium.

A boiling prevention cover (130) may be provided around both end portions of each of the plurality of plates to prevent a boiling phenomenon of the heating medium, which is caused by local overheating due to retention of the heating medium.

A combustion chamber case made of a metal material different from metal materials of the plates constituting the heat exchange unit (100) may be coupled to an outer side surface of the heat exchange unit (100), and an insulating packing (140) may be provided between the heat exchange unit (100) and the combustion chamber case to prevent corrosion of the combustion chamber case caused by a potential difference between different metals.

Through-holes H1, H2, H3, and H4 and blocked portions H1', H2', H3', and H4' may be selectively formed at both end portions of each of the first plate and the second plate to form the flow path of the heating medium passing through the heating medium flow path P1.

Advantageous Effects

In accordance with the present invention, a combustion gas flow path formed between a plurality of heating medium flow paths is formed to be constantly spaced along a flow direction of a combustion gas and to have a curved shape, and thus flow resistance of the combustion gas is reduced, and generation of turbulence is promoted such that heat exchange efficiency between a heating medium and the combustion gas can be improved.

Further, a first turbulence forming protrusion and a second turbulence forming protrusion are formed inside the combustion gas flow path such that an interval of the combustion gas flow path is constantly maintained and the generation of the turbulence is simultaneously promoted in a flow of the combustion gas to improve heat exchange efficiency, and a first reinforcement protrusion and a second reinforcement protrusion are formed to be in contact with each other inside a heating medium flow path such that pressure resistance performance of a first plate and a second plate is increased to improve durability of the heat exchanger.

Furthermore, adjacent unit plates are disposed to form a vertical height difference between the adjacent unit plates such that condensation due to a capillary action at a lower end of the combustion gas flow path can be prevented, and condensate can be smoothly discharged.

In addition, a first flow distributor and a second flow distributor are formed on both end portions of the unit plate, a flow amount of the heating medium is uniformly distributed in a section in which a flow direction of the heating medium is changed, and thus a flow velocity of the heating medium is reduced such that a retention phenomenon of the heating medium can be minimized as well, and a boiling prevention cover is additionally provided around both end portions of the unit plate such that a boiling phenomenon due to local overheating of the heating medium can be prevented, thereby improving thermal efficiency.

Additionally, an insulating packing is provided between a heat exchanging portion and a combustion chamber case such that corrosion of the combustion chamber case caused by a potential difference between different kinds of metals being in contact with each other can be effectively prevented.

DESCRIPTION OF DRAWINGS

FIG. 1 is a perspective view of a curved plate heat exchanger according to the present invention.

FIG. 2 is a perspective view illustrating a state in which a heat exchanging unit, a boiling preventive cover, and an insulating packing have been separated from the curved plate heat exchanger shown in FIG. 1.

FIG. 3 is a plan view of the heat exchange unit.

FIG. 4 is a front view of the heat exchange unit.

FIG. 5 is a left side view of the heat exchange unit.

FIG. 6 is an exploded perspective view of unit plates constituting the heat exchange unit.

FIG. 7 is an enlarged perspective view of a part of the unit plate.

FIG. 8 is a perspective view taken along line A-A of FIG. 3.

FIG. 9 is a perspective view taken along line B-B of FIG. 3.

FIG. 10 is respectively a cross-sectional view and a partial perspective view which are taken along line C-C of FIG. 4.

FIG. 11 is respectively a cross-sectional view and a partial perspective view which are taken along line D-D of FIG. 4.

FIG. 12 is respectively a cross-sectional view and a partial perspective view which are taken along line E-E of FIG. 4.

FIG. 13 is a cross-sectional view taken along line F-F of FIG. 5.

FIG. 14 is a cross-sectional view illustrating a modified embodiment of the heat exchange unit.

| ** Description of Reference Numerals ** | |
|---|---|
| 1: curved plate heat exchanger | 100: heat exchange unit |
| 101: heating medium inlet | 102: heating medium outlet |
| 100-1 to 100-14: unit plates | 100a-1 to 100a-14: first plates |
| 100b-1 to100b-14: second plates | 110: first curved surface |
| 111: first ridge portion | 112: first valley portion |
| 113: first reinforcement protrusion | |
| 114: first turbulence forming protrusion | |
| 115: first flow distributor | 116: first flange |
| 120: second curved surface | 121: second ridge portion |
| 122: second valley portion | |
| 123: second reinforcement protrusion | |
| 124: second turbulence forming protrusion | |
| 125: second flow distributor | 126: second flange |
| 130: boiling prevention cover | 140: insulating packing |
| H1, H2, H3, and H4: through-holes | |
| H1', H2', H3', and H4': blocked portions | |
| P1: heating medium flow path | P2: combustion gas flow path |

MODES OF THE INVENTION

Hereinafter, configurations and operations for preferred embodiments of the present invention will be described in detail with reference to the accompanying drawings.

Referring to FIGS. 1 to 7, a curved plate heat exchanger 1 according to the present invention includes a heat exchange unit 100 configured by stacking a plurality of plates. Further, both sides of the heat exchange unit 100 may be respectively surrounded by a boiling prevention cover 130, and an insulating packing 140 may be attached to an outer side surface of the boiling prevention cover 130 and front and rear surfaces of the heat exchange unit 100.

Hereinafter, a configuration and operation of the heat exchange unit 100 will be described first, and configurations and operation of the boiling prevention cover 130 and the insulating packing 140 will be described below.

In a space between the plurality of plates constituting the heat exchange unit 100, a heating medium flow path P1 through which a heating medium flows and a combustion gas flow path P2 through which a combustion gas generated by combustion in a burner (not shown) flows are alternately formed to be adjacent to each other as shown in FIG. 10. The heating medium may be heating water, hot water, or other fluid.

As one example, the plurality of plates may be configured with first to fourteenth unit plates 100-1, 100-2, 100-3, 100-4, 100-5, 100-6, 100-7, 100-8, 100-9, 100-10, 100-11, 100-12, 100-13, and 100-14, and the unit plates are configured with first plates **100*a*-1, 100*a*-2, 100*a*-3, 100*a*-4, 100*a*-5, 100*a*-6, 100*a*-7, 100*a*-8, 100*a*-9, 100*a*-10, 100*a*-11, 100*a*-12, 100*a*-13, and 100*a*-14 disposed at front sides of the unit plates, and second plates 100*b*-1, 100*b*-2, 100*b*-3, 100*b*-4, 100*b*-5, 100*b*-6, 100*b*-7, 100*b*-8, 100*b*-9, 100*b*-10, 100*b*-11, 100*b*-12, 100*b*-13, and 100*b*-14 disposed at back sides of the unit plates as shown in FIG. 6**. However, the number of the plurality of plates may be differently configured from the present embodiment according to a capacity of the heat exchange unit.

The heating medium flow path P1 is formed in a space between the first plate and the second plate constituting each of the unit plates.

The combustion gas flow path P 2 is formed in a space between the second plate of the unit plate disposed at one side of the unit plate and the first plate of the unit plate disposed adjacent to the second plate so that constant interval along a flow direction of the combustion gas are maintained.

Referring to FIGS. 6, 7, and 10, the first plate includes a first curved surface 110, in which a first ridge portion 111 protruding toward the combustion gas flow path P2 disposed at one side, and a first valley portion 112 protruding toward the heating medium flow path P1. are alternately formed along the flow direction of the combustion gas. A connection portion between the first ridge portion 111 and the first valley portion 112 is formed of an inclined surface.

The second plate is formed in a shape substantially symmetrical with the first plate and includes a second curved surface 120 in which a second ridge portion 121 protruding toward a combustion gas flow path P2 disposed at the other side and a second valley portion 122 protruding toward the heating medium flow path P1 are alternately formed along the flow direction of the combustion gas. A connection portion between the second ridge portion 121 and the second valley portion 122 is formed of an inclined surface.

The first ridge portion 111, which is formed at a first plate disposed at one side of a unit plate among adjacently stacked unit plates, and the second valley portion 122, which is formed at a second plate disposed at the other side of the unit plate thereamong, may be disposed to face each other and spaced apart from each other; and the first valley portion 112 formed at the first plate disposed at the one side of the unit plate and the second ridge portion 121 formed at the second plate disposed at the other side of the unit plate may be formed and spaced apart from each other.

Referring to FIG. 5, the adjacently stacked unit plates are disposed to form a vertical height difference Δh between a height h1 of a unit plate disposed at one side among the adjacently stacked unit plates and a height h2 of a unit plate thereamong disposed adjacent to the unit plate disposed at the one side, so as to allow the first ridge portion 111 of the first plate and the second valley portion 122 of the second plate to be disposed to face each other, and allow the first valley portion 112 of the first plate and the second ridge portion 121 of the second plate to be disposed to face each other.

Therefore, as shown in FIGS. 4 and 10, the first plate and the second plate are formed to be in similar shapes and vertical heights between adjacently disposed unit plates are different, such that the combustion gas flow paths P2 may be configured to have S shapes in regular intervals. Accordingly, flow resistance of the combustion gas passing through the combustion gas flow path P2 along a dotted arrow direction in FIG. 5 can be reduced, a temperature distribution of the combustion gas across an entire area of the combustion gas flow path P2 can be uniformly maintained, and generation of turbulence is promoted in a flow of the combustion gas such that heat exchange efficiency between the combustion gas and the heating medium can be improved.

Further, the adjacently disposed unit plates are disposed to form the vertical height difference Δh therebetween such that condensation due to a capillary action can be prevented at a lower end of the combustion gas flow path P2, and condensate can be smoothly discharged. When unit plates are adjacently disposed at the same height, there is a problem in that water vapor contained in a combustion gas, which is cooled while passing through the combustion gas flow path P2, is condensed such that condensate is formed between a second plate of a unit plate disposed at one side among the adjacently disposed unit plates and a first plate of a unit plate disposed at the other side thereamong, wherein the second plate and the first plate are disposed in parallel at the lower end of the combustion gas flow path P2 at a small distance apart.

On the contrary, when the unit plates are adjacently disposed to form the vertical height difference Δh therebetween as in the present invention, a distance between the second plate of the one unit plate disposed at the one side and the first plate of the unit plate disposed at the other side, the second plate and the first plate being disposed at the lower end of the combustion gas flow path P2, increases such that the capillary action can be prevented and the condensate can be smoothly discharged.

As shown in FIGS. 4, 7, and 11, a first reinforcement protrusion 113 is formed at the first valley portion 112 of the first plate to protrude toward the heating medium flow path P1, and a second reinforcement protrusion 123 is formed at the second valley portion 122 of the second plate to protrude toward the heating medium flow path P1 and to be in contact with the first reinforcement protrusion 113. A plurality of first reinforcement protrusions 113 and second reinforcement protrusions 123 may be respectively formed to be spaced apart from each other along a length direction of the unit plate.

As described above, since a protruding end of the first reinforcement protrusion 113 and a protruding end of the second reinforcement protrusion 123 are configured to be in contact with each other, pressure resistance performance of the first plate and the second plate is improved such that durability of the heat exchanger can be enhanced.

Referring to FIGS. 4 and 7 and 12, a first turbulence forming protrusion 114 is formed at the first valley portion 112 of the first plate to be in contact with the second ridge portion 121 formed at the second plate of an adjacently stacked unit plate, and a second turbulence forming protrusion 124 is formed at the second valley portion 122 of the second plate to be in contact with the first ridge portion 111 formed at a first plate of the adjacently stacked unit plate. A plurality of first turbulence forming protrusions 114 and second turbulence forming protrusions 124 may be respectively formed to be spaced apart from each other along the length direction of the unit plate.

As described above, since the first turbulence forming protrusion 114 of the first plate is configured to be in contact with the second ridge portion 121 of the second plate, and the second turbulence forming protrusion 124 of the second plate is configured to be in contact with the first ridge portion 111 of the first plate, an interval of the combustion gas flow path P2 can be supported and kept constant, and generation of turbulence is simultaneously promoted in a flow of the combustion gas such that heat exchange efficiency can be improved.

Further, as shown in FIG. 7, a first flow distributor 115 is formed at both end portions of the first plate to reduce a cross-sectional area of the heating medium flow path P1 and a flow velocity of the heating medium, and a second flow distributor 125 having a shape symmetrical with the first flow distributor 115 is formed at both end portions of the second plate.

The first flow distributor 115 and the second flow distributor 125 may be respectively formed in a flat embossed shape at both ends of each of the ridge portion 111 of the first plate and the ridge portion 121 of the second plate, and the flat embossed shape can be modified into various shapes.

With the configuration of the first flow distributor 115 and the second flow distributor 125, as will be described below, a flow amount of the heating medium is uniformly distributed in a section in which a flow direction of the heating medium is changed, at both end portions of the unit plate, and thus a flow velocity of the heating medium is reduced to allow the heating medium to flow smoothly such that a boiling phenomenon due to local retention of the heating medium, which may be caused when the heating medium flow is locally biased, can be prevented.

Meanwhile, a first flange 116 is formed at a rim of the first plate, and a second flange 126 is formed at a rim of the second plate and in a shape by which contact with the first flange 116 is made to seal the heating medium flow path P1.

Further, referring to FIGS. 6, 7, 8, and 9, through-holes H1, H2, H3, and H4 and blocked portions H1', H2', H3', and H4' may be selectively formed at both end portions of each of the first plate and the second plate to form a flow path of the heating medium passing through the heating medium flow path P1.

As one example, as shown in FIG. 6, a heating medium flowing into the heating medium flow path P1 of the first unit plate 100-1 through the heating medium inlet 101 formed at one side of the first plate **100*a*-1 of the first unit plate 100-1 is blocked by the blocked portion H4' formed at one side of the second plate 100*b*-1 and is guided to one side of the heating medium flow path P1, and the heating medium passes through the through-hole H3 formed at the other side of the second plate and the through-hole H1 formed at one side of a first plate 100*a*-2 of a second unit plate 100-2 disposed behind the first unit plate 100-1 to flow into a heating medium flow path P1 of the second unit plate 100-2**.

The heating medium flowing into the heating medium flow path P1 of the second unit plate 100-2 is blocked by the blocked portion H3' formed at one side of the second plate **100*b*-2 and is guided to one side of the heating medium flow path P1, and then the heating medium passes through the through-hole H4 formed at one side of a second plate 200*b*-2 and the through-hole H2 formed at one side of a first plate 100*a*-3 of a third unit plate 100-3 disposed behind the second plate 200*b*-2 to flow into a heating medium flow path P1**.

As described above, the flow direction of the heating medium is alternately changed from the one side to the other side, and the heating medium sequentially passes and is discharged through the heating medium outlet 102 formed at the fourteenth unit plate 100-14 disposed at the rearmost position.

With such a configuration, the heating medium flows as indicated by the solid arrows in FIG. 13.

In this example, the heating medium flow path P1 is formed in a series structure and is configured such that the flow direction of the heating medium in the unit plate disposed at the one side is opposite to the flow direction of the heating medium in the unit plate disposed at the other side.

In another example, as shown in FIG. 14, a heating medium flow path P1 is formed in a series-parallel mixed structure, and the heating medium flow path P1 is configured such that a flow direction of a heating medium in a plurality of unit plates disposed at one side and a flow direction of a heating medium in a plurality of unit plates stacked adjacent to the plurality of unit plates may alternately oppose each other.

As described above, the flow path of the heating medium may be variously different according to formation positions of the through-holes H1, H2, H3, and H4 and the blocked portions H1', H2', H3', and H4' which are formed at the first plate and the second plate.

Accordingly, since the flow path of the heating medium is changed at both end portions of the heat exchange unit 100 to allow the heating medium to flow, the flow of the heating medium is slowed at both end portions of the heat exchange unit 100, and thus the heating medium is heated by the combustion heat generated in the combustion chamber such that a boiling phenomenon of the heating medium may occur to cause deterioration of thermal efficiency and generation of noise.

As a configuration for preventing the boiling phenomenon of the heating medium at both end portions of the heat exchange unit 100, a boiling prevention cover 130 is provided at both end portions of the heat exchange unit 100.

Referring to FIGS. 1 and 2, the boiling prevention cover 130 may include a side surface portion 131, and may include an upper end portion 132 and a lower end portion 133 extending from upper and lower ends of the side surface portion 131 toward the heat exchange unit 100 and may be made of a stainless steel (SUS) the same as that of the plates constituting the heat exchange unit 100.

Further, a combustion chamber case (not shown) may be coupled to an outer side surface of the heat exchange unit 100 and be made of a steel material coated with an aluminum layer. In this case, since the plates of the heat exchange unit 100, the boiling prevention cover 130, and the combustion chamber case are made of different materials, corrosion of the combustion chamber case may occur due to a potential difference between different metals in being contact with each other.

As a configuration for preventing the corrosion, an insulating packing 140 made of a ceramic or an inorganic material is provided at an outer surface of the boiling prevention cover 130 and front and rear surfaces of the heat exchange unit 100 to prevent a potential difference between the boiling prevention cover 130 and the heat exchange unit 100.

According to such a configuration, the combustion chamber case is made of a steel material coated with an aluminum layer, which is relatively inexpensive as compared with the stainless steel material, so that a manufacturing cost of the boiler can be reduced and at the same time the corrosion of the combustion chamber case can be effectively prevented to enhance durability of the boiler.

The invention claimed is:

1. A curved plate heat exchanger comprising:

a heat exchange unit including a heating medium flow path (PI) formed in a plurality of plates between a heating medium inlet and a heating medium outlet and also including a combustion gas flow path (P2) formed in the plurality of plates, the heating medium flow path and the combustion gas flow path disposed in an alternating manner relative to each other and also disposed adjacent to each other in the plurality of plates, the plurality of plates in turn comprising a plurality of unit plates, a first plate and a second plate stacked to form each unit plate of the plurality of unit plates, wherein the heating medium flow path (PI) is formed between the first plate and the second plate of each of the plurality of unit plates, wherein the combustion gas flow path (P2) is formed between a second plate disposed at one side of a unit plate of any two adjacently stacked unit plates of the plurality of unit plates and a first plate disposed at the other side of said unit plate of the two adjacently stacked unit plates of the plurality of unit plates, wherein the heating medium inlet and the heating medium outlet are longitudinally aligned along a mutually shared longitudinal axis, and wherein each of the plurality of unit plates is disposed in a staggered relationship relative to each immediately adjacent one of the remaining plurality of unit plates in a direction perpendicular to the mutually shared longitudinal axis of the heating medium inlet and the heating medium outlet such that there is a height difference (Δh) between the height (h1) of a given unit plate of the plurality of unit plates and the height (h2) of each of the immediately adjacent unit plates of the plurality of unit plates corresponds to said staggered relationship among the immediately adjacent unit plates of the plurality of unit plates.

2. The curved plate heat exchanger of claim 1, wherein:

the first plate includes a first curved surface having a first ridge portion so as to be recessed toward the combustion gas flow path (P2) disposed at the one side and a first valley portion so as to be recessed toward the heating medium flow path (P1), and the first ridge portion and the first valley portion are alternately formed, and the second plate includes a second curved surface having a second ridge portion so as to be recessed toward the combustion gas flow path (P2) disposed at the other side, and a second valley portion so as to be recessed toward the heating medium flow path (P1), and the second ridge portion and the second valley portion are alternately formed.

3. The curved plate heat exchanger of claim 2, wherein:

the first ridge portion, which is formed at the first plate disposed at the one side of the unit plate among the plurality of unit plates, and the second valley portion, which is formed at the second plate disposed at the other side of the unit plate among the plurality of unit plates, are disposed to face each other and so as to be spaced apart from each other, and the first valley portion formed at the first plate of the unit plate disposed at the one side and the second ridge portion formed at the second plate of the unit plate disposed at the other side are disposed to face each other and so as to be spaced apart from each other.

4. The curved plate heat exchanger of claim 3, wherein:

a first turbulence forming protrusion is formed at the first valley portion of the first plate so as to be in contact with the second ridge portion formed at the second plate of the adjacently stacked unit plates, and a second turbulence forming protrusion is formed at the second valley portion of the second plate so as to be in contact with the first ridge portion formed at the first plate of the plurality of unit plates.

5. The curved plate heat exchanger of claim 4, wherein a plurality of first turbulence forming protrusions and second turbulence forming protrusions are formed and spaced apart from each other along the length direction of the plurality of unit plates.

6. The curved plate heat exchanger of claim 2, wherein:

a first reinforcement protrusion is formed at the first valley portion of the first plate so as to protrude toward the heating medium flow path (P1), and a second reinforcement protrusion is formed at the second valley portion of the second plate so as to protrude toward the heating medium flow path (P1) and so as to be contact with the first reinforcement protrusion.

7. The curved plate heat exchanger of claim 6, wherein a plurality of first reinforcement protrusions and second reinforcement protrusions are formed and spaced apart from each other along the length direction of the plurality of unit plates.

8. The curved plate heat exchanger of claim 1, wherein:

the heating medium flow path (P1) is formed within the plurality of unit plates in a series structure, and the flow path is configured such that a flow direction of the heating medium in the unit plate disposed at the one side and a flow direction of the heating medium in the unit plate disposed at the other side are alternate and opposite to each other.

9. The curved plate heat exchanger of claim 8, wherein a first flow distributor and a second flow distributor are formed at both end portions of each of the plurality of unit plates to reduce a cross-sectional area of the heating medium flow path (P1) and a flow velocity of the heating medium.

10. The curved plate heat exchanger of claim 8, wherein a boiling prevention cover is provided around both end portions of each of the plurality of plates to prevent overheating and boiling of the heating medium due to retention of the heating medium.

11. The curved plate heat exchanger of claim 8, wherein:

a combustion chamber case made of a metal material having a different composition than the compositions of the metal materials of the plates constituting the heat exchange unit, and the combustion chamber case to an outer side surface of the heat exchange unit, and an insulating packing is provided between the heat exchange unit and the combustion chamber case to prevent corrosion of the combustion chamber case caused by a potential difference between the metal material of the combustion chamber case and the metal materials of the plates.

12. The curved plate heat exchanger of claim 8, wherein through-holes H1, H2, H3, and H4 and blocked portions H1', H2', H3', and H4' are selectively formed at both end portions of each of the first plate and the second plate to form the heating medium flow path P1.

13. The curved plate heat exchanger of claim 1, wherein:

the heating medium flow path (P1) is formed within the plurality of unit plates in a mixed series-parallel structure, and the flow path is configured such that a flow direction of the heating medium in one plurality of unit plates and a flow direction of the heating medium in the other plurality of unit plates disposed to be adjacent to the one plurality of unit plates are opposite to each other.

14. The curved plate heat exchanger of claim 13, wherein a first flow distributor and a second flow distributor having a flat embossed shape are formed at both end portions of each of the plurality of unit plates to reduce a cross-sectional area of the heating medium flow path (P1) and a flow velocity of the heating medium.

15. The curved plate heat exchanger of claim 13, wherein a boiling prevention cover is provided around both end portions of each of the plurality of plates to prevent overheating and boiling of the heating medium due to retention of the heating medium.

16. The curved plate heat exchanger of claim 13, wherein:

a combustion chamber case is made of a metal material having a different composition than the compositions of the metal materials of the plates constituting the heat exchange unit, and the combustion chamber case is coupled to an outer side surface of the heat exchange unit, and an insulating packing is provided between the heat exchange unit and the combustion chamber case to prevent corrosion of the combustion chamber case caused by a potential difference between the metal material of the combustion chamber case and the metal materials of the plates.

17. The curved plate heat exchanger of claim 13, wherein through-holes (H1, H2, H3, and H4) and blocked portions (H1', H2', H3', and H4') are selectively formed at both end portions of each of the first plate and the second plate to form the flow path of the heating medium passing through the heating medium flow path (P1).

* * * * *